US010201472B2

(12) United States Patent
Richardson, II

(10) Patent No.: US 10,201,472 B2
(45) Date of Patent: Feb. 12, 2019

(54) TRI-MOTION TACTILE STIMULATION DEVICE

(71) Applicant: Neue Kinetik, LLC, Lexington, KY (US)

(72) Inventor: William Wallace Richardson, II, Lexington, KY (US)

(73) Assignee: NEUE KINETIK, LLC, Lexington, KY (US)

( * ) Notice: Subject to any disclaimer, the term of this patent is extended or adjusted under 35 U.S.C. 154(b) by 454 days.

(21) Appl. No.: 14/742,139

(22) Filed: Jun. 17, 2015

(65) Prior Publication Data

US 2015/0359703 A1 Dec. 17, 2015

Related U.S. Application Data

(60) Provisional application No. 62/013,206, filed on Jun. 17, 2014.

(51) Int. Cl.
*A61H 23/02* (2006.01)
*A61H 19/00* (2006.01)

(52) U.S. Cl.
CPC ..... *A61H 23/0263* (2013.01); *A61H 19/44* (2013.01); *A61H 2201/0111* (2013.01); *A61H 2201/1454* (2013.01); *A61H 2201/169* (2013.01); *A61H 2201/1683* (2013.01); *A61H 2201/5097* (2013.01)

(58) Field of Classification Search
CPC .... A61H 19/44; A61H 23/0263; A61H 19/34; A61H 2201/0103; A61H 2201/0111; A61H 2201/0207; A61H 2201/0214; A61H 2201/1215; A61H 2201/123; A61H 2201/1436; A61H 2201/1454; A61H 2201/149
See application file for complete search history.

(56) References Cited

U.S. PATENT DOCUMENTS

| | | | |
|---|---|---|---|
| 4,604,993 | A | 8/1986 | Moriwaki et al. |
| 5,067,480 | A | 11/1991 | Woog et al. |
| 6,422,993 | B1 | 7/2002 | Hudson |
| 6,478,755 | B2 | 11/2002 | Young |
| 6,902,525 | B1 | 6/2005 | Jewell |

(Continued)

FOREIGN PATENT DOCUMENTS

| | | | |
|---|---|---|---|
| DE | 102010018391 | A1 | 10/2011 |
| JP | 2006110289 | A | 4/2006 |

(Continued)

OTHER PUBLICATIONS

DE102010018391A1—English MachineTranslation.
JP2006110289—English MachineTranslation.

*Primary Examiner* — Christine H Matthews
(74) *Attorney, Agent, or Firm* — King & Schickli, PLLC

(57) ABSTRACT

A portable device for use in the application of simultaneous radial vibration, orbital motion and rotational or torsional oscillation to a person. The device includes: (1) a power unit for housing a power source to supply power to the apparatus; (2) a motor having an output shaft positioned within the power unit; (3) a stimulator for directly translating rotational energy into orbital motion, creating rotational or torsional oscillation, and producing random radial vibration; and (4) a flexible covering surrounding the device.

18 Claims, 6 Drawing Sheets

(56) References Cited

U.S. PATENT DOCUMENTS

| | | | | |
|---|---|---|---|---|
| 6,991,598 | B2 | 1/2006 | Klein | |
| 7,749,178 | B2 | 7/2010 | Imboden et al. | |
| 7,815,582 | B2 | 10/2010 | Imboden et al. | |
| 7,931,605 | B2 | 4/2011 | Murison | |
| 8,496,572 | B2 | 7/2013 | Lee | |
| 8,672,832 | B2 | 3/2014 | Lee | |
| 8,821,421 | B2 | 9/2014 | Imboden et al. | |
| 9,114,056 | B2 | 8/2015 | Imboden et al. | |
| 9,119,765 | B2 | 9/2015 | Topolev | |
| 9,132,058 | B2 | 9/2015 | Imboden et al. | |
| 2004/0082831 | A1* | 4/2004 | Kobashikawa | A61H 19/34 600/38 |
| 2008/0139980 | A1* | 6/2008 | Fladl | A61H 19/34 601/70 |
| 2013/0197302 | A1 | 8/2013 | Levy | |
| 2014/0309565 | A1* | 10/2014 | Allen | A61H 19/44 601/46 |

FOREIGN PATENT DOCUMENTS

| | | | |
|---|---|---|---|
| WO | 2009/012172 | A2 | 1/2009 |
| WO | 2013/138658 | A1 | 9/2013 |

* cited by examiner

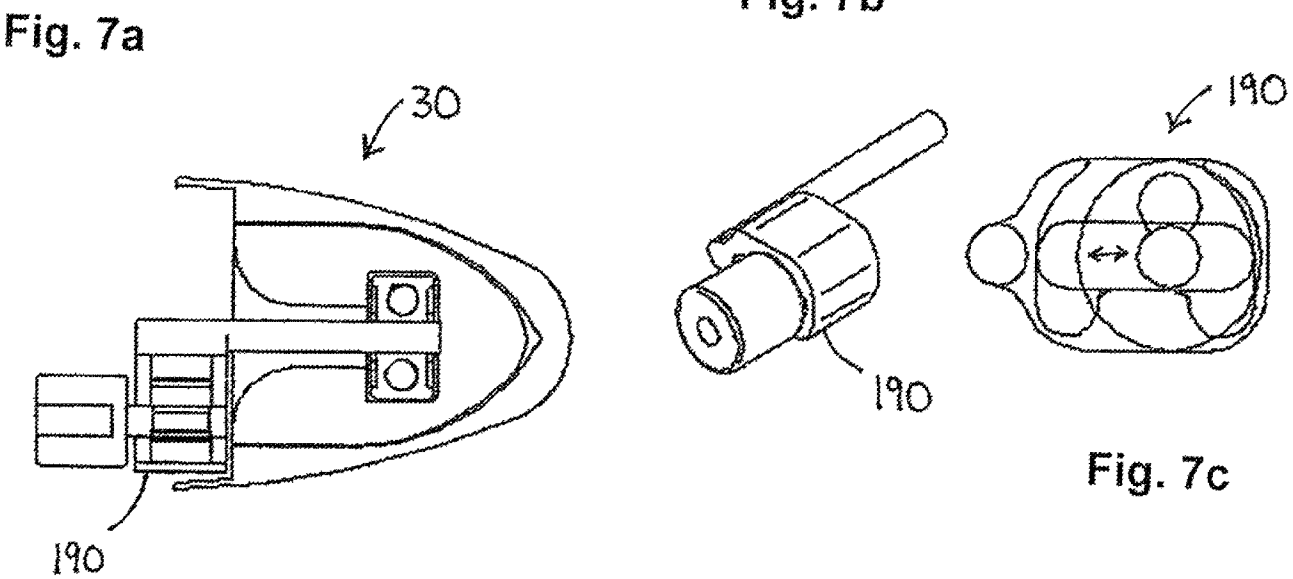
Fig. 7a
Fig. 7b
Fig. 7c
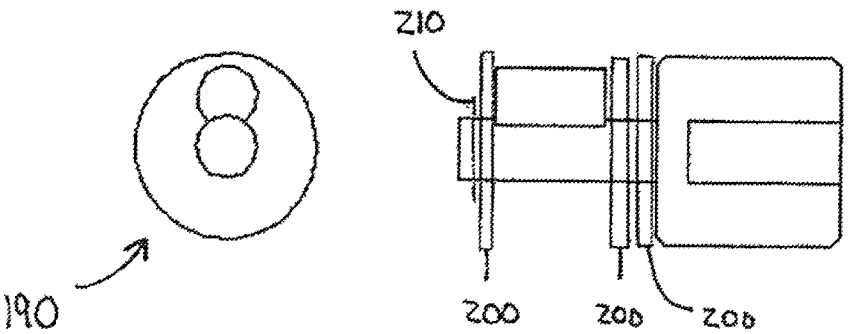
Fig. 7e
Fig. 7d

TRI-MOTION TACTILE STIMULATION DEVICE

This application claims the benefit of U.S. Provisional Patent Application Ser. No. 62/013,206, filed on Jun. 17, 2014, the disclosure of which is incorporated herein by reference.

TECHNICAL FIELD

This disclosure relates generally to an apparatus for use in sexual devices and massage instruments and, more particularly, to an apparatus for promoting tactile stimulation that utilizes radial vibration, orbital motion and rotational or torsional oscillation.

BACKGROUND

It is well known that many personal appliances or small mechanical devices in the form of sexual devices and massage instruments use rotational drive energy or servo drives in the generation of fine movements, such as radial vibration. Conventional masturbation and massage devices typically provide radial vibratory energy, rotational energy or oscillations in two axes. Generally, devices with this type of energy translation exist as a healthy sexual outlet and can be valuable tools in sex-therapy, including enhancement of one's sexual awareness and reduction of fears of intimacy. A large majority of women, in particular, cannot achieve climax without external stimulation. Devices that allow masturbation have the potential to decrease unwanted births and decrease the transmission of sexually transmitted disease, as they can be implemented without a partner. Furthermore, the utility of self-massage devices is well known, as there are many commercially available. Indeed, there exists a multitude of hand held scratching, vibrating and dual-action massagers.

In 2003, an exhaustive analysis of the market for sexual devices was performed as perhaps best described in U.S. Pat. No. 6,902,525 to Jewell. Specifically, a need was identified for sexual devices to provide enhanced personal pleasure for people with all types of sexual dispositions. The most common of these devices currently available is the vibrator or vibrating dildo or vibrating massager. While these types of devices are commonly known and cheaply made, they provide less than optimal stimuli—mostly random and primarily radial impulses.

Typically, the common feature among these devices is a simple unbalanced weight driven by a motor. One of the most popular vibrating massage devices is made by Hitachi, and it is unique in that the weight is supported by bearings in a stimulator section which is distal to the motor and wrapped in a flexible material. This design gives more freedom for the stimulator and protects the motor from radial loads. It was a generous leap forward in terms of massager/stimulator design, but it does not directly create larger amplitude percussive or mechanical slip motions that can activate specialized sensory receptors found in human genitalia.

Histological analysis of the human genitalia supports the relevance of diverse stimuli. The sensory receptors in the human genitalia are unique in distribution and type, even among glabrous (non-hair containing) skin. The human penis contains a large number of free nerve endings, as well as more complex corpuscular receptors. The density and type of receptor affect the types of stimuli that a particular area of skin can perceive and the sensitivities to such. For example, the distal aspect of the penis has poor fine touch sensation when compared to its ability to sense pressure and pain. The foreskin on the other hand, has a larger number of fine touch or specialized corpuscular receptors. These more complex receptors are higher in density around the corona and transition zones between the prepuce and glans. In the female clitoris, similar receptor distributions/types can be found, as the clitoris is embryologically related to the penis.

A variety of adaptation times can be found among the types of sensory receptors in the genital organs. Some possess fast adaptation times that produce a decrease in output with constant stimulation, and some have slow adaptation times. An effective stimulator will maximally activate a range of receptors including the mechano-receptors that increase their output based on the degree of pressure or deformation of the skin as well as the slow adapting receptors that respond to stretch. Enhanced stimulation of the genitalia cannot be accomplished through a simple medium-frequency vibration that creates minimal stretch and displacement of sensory receptors. Many genital mechano-receptors will respond to this through adaptation with a decrease in sensory receptor output over time.

Therefore, there exists a need for a device designed to provide a safe method of effective tactile stimulation that provides additional mechanical stimulation through vibrating, orbiting and torsional (or rotational) oscillations. Furthermore, the device should have the additional benefit of increased stimulation as well as superior massage characteristics by generating slip and additional pressure stimuli. The device should be capable of being used alone or as an implement on other commercially available devices.

SUMMARY

In accordance with one aspect of the disclosure, a portable device for use in the application of simultaneous radial vibration, orbital motion and rotational or torsional oscillation to a person is provided. The device includes: (1) a power unit for housing a power source to supply power to the apparatus; (2) a motor having an output shaft positioned within the power unit; (3) a stimulator for directly translating rotational energy into orbital motion, creating rotational or torsional oscillation, and producing random radial vibration; and (4) a flexible covering surrounding the device.

In one embodiment, the power unit may include a removable access cap having a variable speed and direction controller for the device. The power source may be a battery. The flexible covering may include a material having an elastic property that aids in the control of oscillatory amplitudes. The power unit may be controlled wirelessly. The output shaft may be flexible to protect the motor from radial loads. The power unit may be programmable to provide modes with varying speed, direction, on/off cycling, and enhanced torsional control and orbit control.

In another embodiment, the stimulator includes: (1) an eccentric coupling connected to the output shaft weighted to enhance radial vibration from the stimulator; (2) a second shaft extending distal to the eccentric coupling, wherein the second shaft is mounted in the coupling at variable radii in relation to the output shaft and extending distal into the stimulator; and (3) an element affixed to the distal end of the second shaft with an outside surface fitted within the stimulator to prevent the stimulator and flexible covering from continuous winding with the second shaft and to free the stimulator to allow torsional oscillation. The eccentric coupling may possess an arm for changing the radius controlled by the direction of the motor output. The element may be a sealed-ball bearing, a clutch assembly to control torsional oscillation or a separate DC motor with independent control of torsional oscillation. The stimulator may further include a stimulator cap for altering the profile of the stimulator and altering the radius of the orbit.

In accordance with another aspect of the disclosure, a tri-motion tactile stimulation device for producing simultaneous radial vibration, orbital motion and rotational or torsional oscillation to a person is provided. The device includes: (1) a first portion having a power supply, a rotary motor with an output shaft and a controller; (2) a second portion having an active segment with an eccentric coupler for generating the radial vibration and an axle securely connected to the eccentric coupler for carrying out an orbit of the second portion; and (3) a flexible covering surrounding the first and second portions. In one embodiment, the flexible covering may be made of silicon and be waterproof, removable and/or capable of changing color with temperature changes. The flexible covering facilitates the orbital and torsional oscillatory movements of the second portion of the device.

In yet another aspect of this disclosure, a portable, variable-speed stimulation device is disclosed. The device includes a power unit having an access cap connected thereto, a stimulating unit having a weighted coupler for modulating the amplitude of the radial vibration and the radius of an orbit of the stimulating unit and a cap and a DC ball bearing motor having an output shaft projecting into the stimulating unit. A gap between the stimulating unit and the power unit enables orbiting and torsion of the stimulating device such that the device simultaneously produces orbital motion, torsional oscillation and radial vibration.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings:

FIGS. 7*a*-7*e* are various views of an eccentric coupler forming another aspect of this disclosure.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized and that process or other changes may be made without departing from the scope of the disclosure. The following detailed description is not to be taken in a limiting sense, and the scope of the invention is defined only by the appended claims and their equivalents. In accordance with the disclosure, a tri-motion tactile stimulation device or apparatus is hereinafter described. The device is designed to take rotational energy and convert that energy into a vibrating, orbiting and torsing stimulator for the purpose of massage and sexual stimulation.

Turning to FIGS. 1-4, it shows a mobile tri-motion tactile stimulation device 10 in a standard configuration that provides effective sexual stimulation or massage to the person using the device. The device 10 includes a body or housing made of a lightweight and durable material, such as polyvinyl chloride (PVC) or high density polyethylene. The device may also be cordless for easy use. Furthermore, the device 10 may be variable-speed, programmable, affordable, water-proof, multi-modal and tunable. Advantageously, the device 10 is gender neutral. The device uses rotary energy to create orbital movement, torsional oscillation as well as radial vibration.

Figure 1:
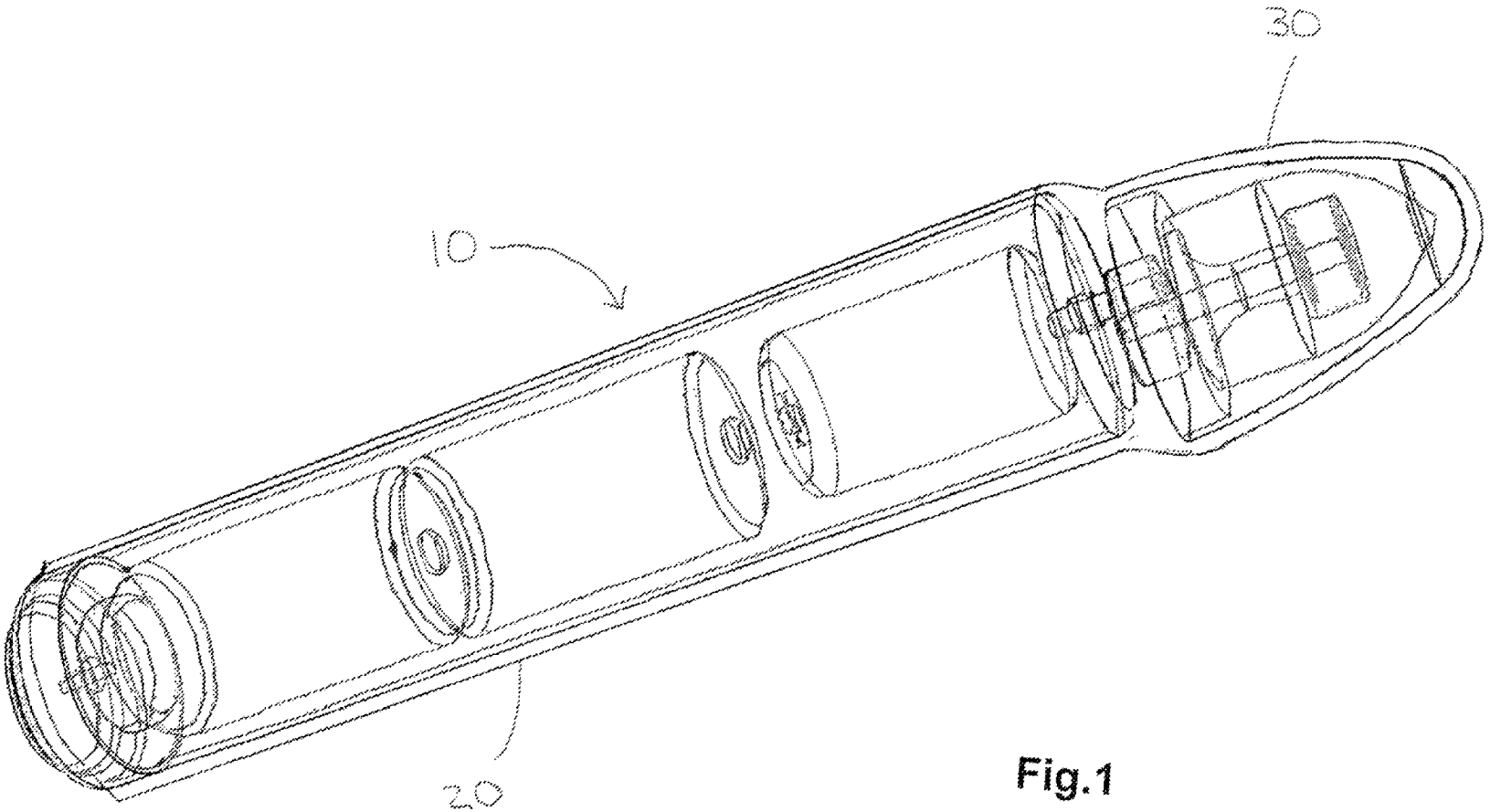
FIG. 1 is a perspective view of a stimulation device with a flexible covering forming one aspect of this disclosure.
Figure 2:
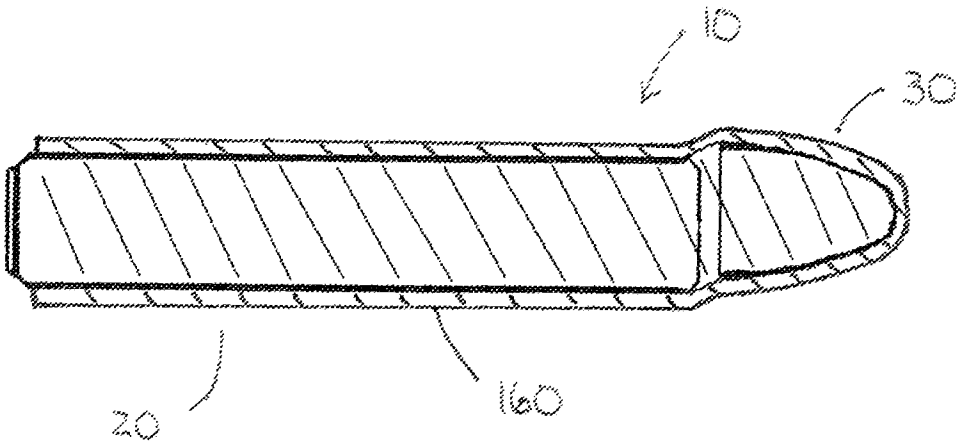
FIG. 2 a side view of the stimulation device with the flexible covering forming one aspect of this disclosure.

The device 10 typically includes a power unit or battery compartment 20 and a stimulator segment or active segment 30 as illustrated in FIG. 1. The power unit 20 is comprised of a hollow cylinder to hold battery power, with a removable access cap 40 containing variable speed control. Furthermore, the power unit 20 is programmable to provide different modes of operation, including but not limited to varying speed, on/off cycling and enhanced torsional and orbit control. The access cap 40 is designed to ensure watertightness and a means for external manipulation of a variable control or voltage control 50. The means for external manipulation of the variable or voltage control 50 may be a physical rotary control switch, a magnetic switch, a knurled disk, a shielded push-button control or the like for varying the speed and direction of the device. Specifically, changing the polarity associated with the controller will change the direction of the device. In one embodiment, the variable control 50 is attached to a variable electric resistor that varies the output voltage from at least one power supply or source 60 located within the power unit 20. The power unit control or control circuit 55 includes the variable electric resistor and/or a programmable circuit.

The external control means 50 utilizes a flexible O-ring 70 to prevent water infiltration into the access cap 40. The access cap 40 is affixed to the power unit cylinder via threading and has a gasket 80 to prevent water penetration. It should be appreciated that multiple approaches could be taken to control the voltage from the power unit 20. For example, push button water-proof, film-type control or magnetic or wireless control may be used to initiate the power for the power unit 20. The power supply 60 may be in the form of a battery unit, which may be easily removable for recharging and/or replacement. Other embodiments could include batteries or capacitors using other chemistry, plug-in rechargeable batteries, external power, or a completely sealed power unit that utilizes inductive charging or kinetic/inductive charging means. The power unit 20 may be electrically fused and contains a means to control heat. For example, a thermally-active fuse and a housing that insulates the user from the motor may be the means to control heat.

At the distal end of the power unit 20 is a direct-current, high-torque ball bearing motor 90 that is relatively small. The motor 90 is keyed into the power unit cylinder 20. The motor 90 has a durable output shaft 100 that can project into the stimulator segment 30. It would be possible to minimize the radial loads on the motor and provide a safety means by making the output shaft 100 of a flexible material, such as spring steel. The output shaft 100 may be supported by a bearing.

Figure 4:
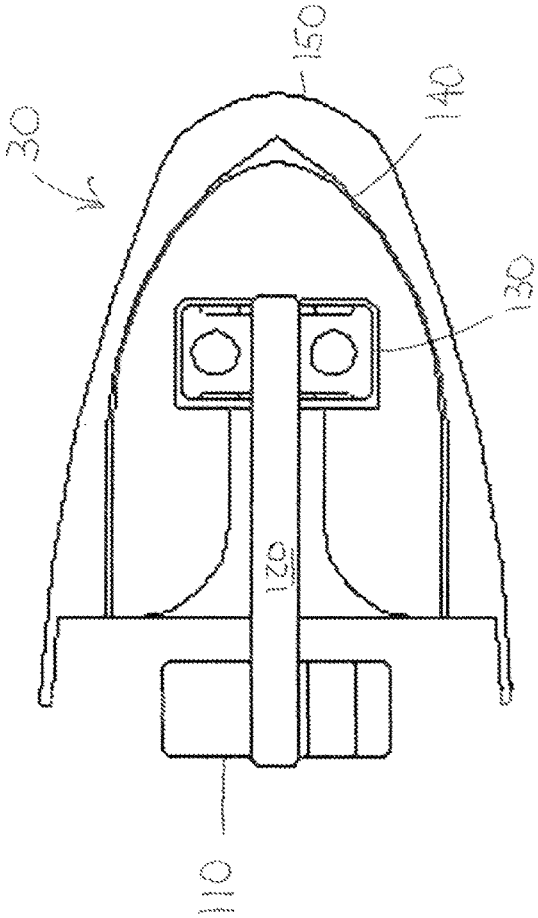
FIG. 4 is a side partial cut-away view of a stimulation segment of the device forming another aspect of this disclosure.
Figure 3:
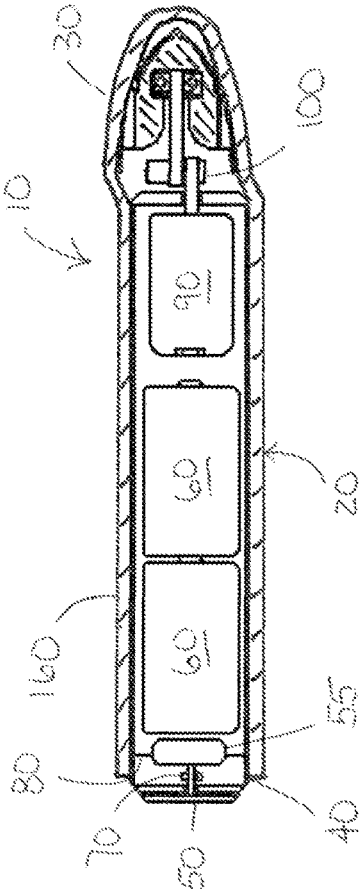
FIG. 3 is a side partial cut-away view of the stimulation device with the flexible covering forming one aspect of this disclosure.

Turning to FIG. 4, the stimulator segment 30 contains a weighted or dense eccentric coupler 110 with two apertures. The weighted coupler 110 generates and modulates both the amplitude of the radial vibration as well as the radius of the stimulator segment orbit. The orbit is carried out via a second shaft or axle, the stimulator axle 120, which is discussed in more detail below. The weighted coupler 110 is securely connected to the output shaft 100 via a press fit or other suitable means. The stimulator segment 30 may be protected from inadvertent disassembly through at least one flexible safety wire connecting the power unit to the stimulator.

Radial to the output shaft, the second aperture in the weighted coupler is used to hold the proximal stimulator axle 120. The stimulator axle 120 is securely connected to the weighted coupler 110. Specifically, the stimulator axle 120 may be press-fitted to the weighted coupler in an offset fashion, projecting distally. Importantly, security measures may be employed, such as various fasteners to prevent disengagement and slipping. The opposite or distal end of the stimulator axle 120 is pressed securely into an inner opening of a sealed ball bearing 130, which is surrounded by a flexible bedding 140, preferably made of rubber. The flexible bedding 140 is tightly pressed into the rigid stimulator cap 150. Alternatively, the stimulator cap 150 and flexible bearing bedding 140 may be a single element wherein the bedding actually forms the cap. The sealed ball bearing's outer race maintains a nearly constant heading such that the stimulator does not rotate with the second shaft.

The stimulator cap 150 has a wider bell portion that has a similar diameter to the power unit cylinder 20 and a gap exists between the primary components. The gap between the rigid portion of the power unit and the bell of the stimulator cap enables orbiting and torsion of the active segment of the device. Alternatively, the stimulator segment could take the form of a capsule or a number of different shapes, such as a cone with a shallow domed protrusion. Surrounding the entire assembly is durable elastic flexible covering 160 that completes the water-proofing. The flexible covering 160 may be made of silicon or other thermoplastic material. Furthermore, this covering provides the bridge between the stimulator segment 30 and the power unit 20. The flexible bridge to allows and facilitates the orbital and torsional oscillatory movements of the stimulator segment of the device.

Moreover, the flexible covering is capable of eliminating three hundred sixty degree (360°) independent rotation of the stimulator by bridging the power source housing to the stimulator, thereby allowing orbiting and oscillating torsion through stretch or elasticity. It should be appreciated that careful tuning of the stimulator segment weight, the weighted coupler, the imbalance of the stimulator cap, the stimulator cap clock position, the radius and velocity of the orbit and the flexible covering, can be used to control the character of the orbit, vibration and torsional oscillation. The flexible covering 160 is waterproof and removable. Importantly, the flexible covering is easily cleaned and sterilized by placing it in a steam or chemical sterilization device. In one embodiment, the flexible covering may change colors with temperature changes. The flexible covering 160 may be further used to seal a union between the power unit 20 and the access cap 40.

As should be appreciated, the principle elements in this embodiment become the unbalanced stimulator cap sitting over a bearing and the small gap bridged by the flexible covering. The orbiting/rotating motion of the stimulator segment, together with the small resistance in the bearing allow the stimulator segment "wind-up," stretch the flexible covering and release to initiate torsional oscillations with variable amplitudes. Increasing the rigidity (modulus) of the flexible covering or increasing the tension within the material decreases the amplitude of the torsional oscillation. Allowing more freedom between the stimulator segment and the power unit, by loosening the bridge material or decreasing its modulus, creates the opposite effect. External resistance at a fixed point along the path of the stimulator segment creates a variable response, the most common of which is an effective increase in torsional amplitudes. Other design benefits are aimed at increasing safety and flexibility for the user. The flexible bedding in the stimulator cap is capable of decreasing the percussive effects of the stimulator segment if held against a fixed object. The ball bearing in the stimulator section facilitates reduced torsion if the device is sufficiently clamped. The shape of the stimulator segment enables a user to increase or decrease slip, orbital and percussive energy by utilizing different surfaces along the bell-shaped stimulator cap.

Figure 5:
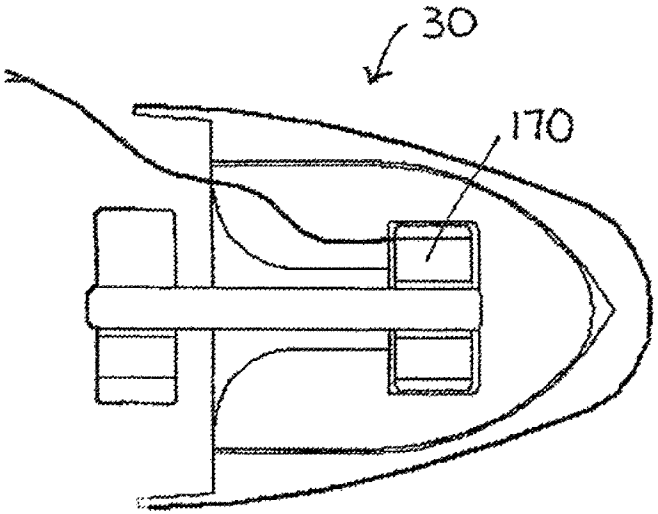
FIG. 5 is a side partial cut-away view of a stimulation segment of the device forming another aspect of this disclosure.

In another embodiment illustrated in FIG. 5, the sealed ball bearing is replaced by a non-powered, low-torque clutch-and-release assembly or a miniature electrical clutch assembly 170 that can further vary the amplitude of the torsional oscillation. With the electric clutch, a programmable circuit can control the amplitudes and the periodicity of the torsional slip forces. This could be made wireless or programmable and controlled via a Bluetooth device or similar mobile electronic device. It should be appreciated that the programmable circuit and wireless and programmable capabilities applies to the entire device.

Figure 6:
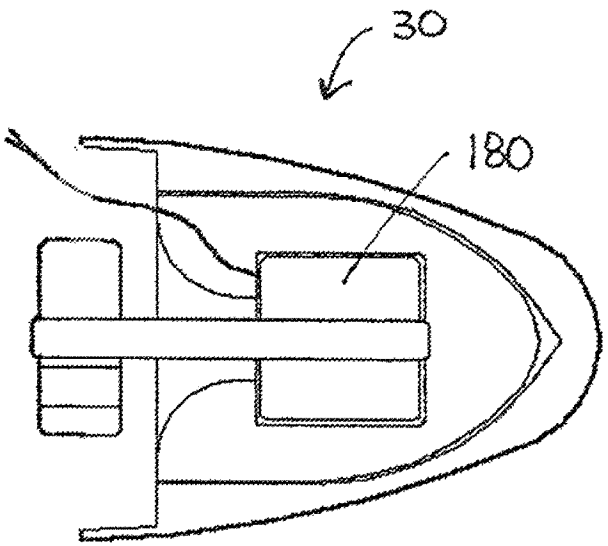
FIG. 6 is a side partial cut-away view of a stimulation segment of the device forming another aspect of this disclosure.

Turning to FIG. 6, a separate DC motor 180 could be used to replace the bearing. In this embodiment, the second motor's output shaft is directed proximally into the weighted coupler, which would offer increased control of the torsional movements through braking and acceleration and could be made wireless and/or programmable.

With respect to FIGS. 7*a*-7*e*, a complex weighted coupler 190 may be used to reduce the distance between the stimulator axle and the motor output shaft when the DC motor turns in one direction and that increases when the DC motor turns in the opposite direction. Advantageously, this would give the operator the ability to change the amplitude of the percussive orbital impulses and would affect the amplitude of the torsional movements. Specifically, FIG. 7*b* illustrates the coupler 190 including the stimulator axle and a cylinder, which affixes the coupler to the motor output shaft. FIG. 7*c* shows an internal view of the coupler. Turning to FIGS. 7*d* and 7*e*, they illustrate a side view of the input shaft of the coupler including and a plurality of shims or washers 200 along with a retaining means 210, such as a C-clip.

Figure 8:
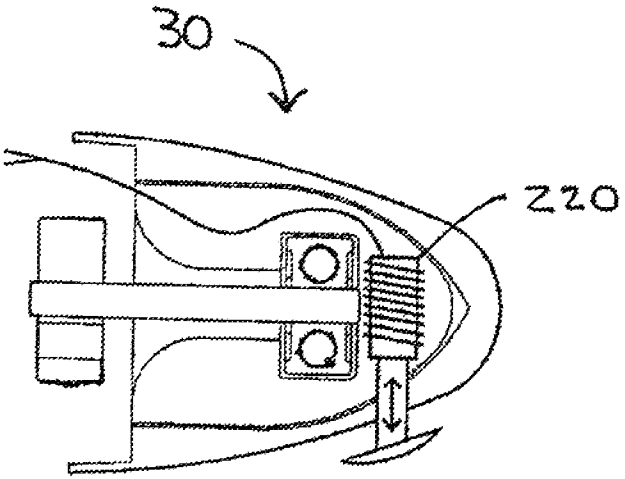
FIG. 8 is a side partial cut-away view of a stimulation segment of the device forming another aspect of this disclosure.

In yet another embodiment illustrated in FIG. 8, the stimulator segment 30 may include a device for altering the profile of the stimulator segment and altering the radius of the orbit. The device may be an electro-solenoid or group thereof, an electro-active shape memory polymer or a thermally active shape-memory polymer. The profile of the stimulator not only changes the orbit, but it creates more imbalance of the stimulator segment 30, which increases the amplitude of the torsional oscillation. For example, the stimulator cap could be replaced by a "corn kernel" shaped electric morphing unit 220 or electroactive shape-memory polymer to change the shape and characteristics of the orbit and torsional oscillation. Shape or balance of the stimulation segment or section could be controlled by these means.

The foregoing descriptions of various embodiments have been presented for purposes of illustration and description. These descriptions are not intended to be exhaustive or to limit the invention to the precise forms disclosed. The embodiments described provide the best illustration of the inventive principles and their practical applications to thereby enable one of ordinary skill in the art to utilize the disclosure in various embodiments and with various modifications as are suited to the particular use contemplated.

The invention claimed is:

1. A portable device for use in the application of simultaneous radial vibration, orbital motion and either rotational or torsional oscillation to a person, comprising:

a power unit housing a power source to supply power to the device;

a motor having an output shaft positioned within the power unit;

a stimulator directly translating rotational energy into orbital motion, creating rotational or torsional oscillation, and producing random radial vibration;

an eccentric coupling connected to the output shaft; and a flexible covering surrounding the device.

2. The device according to claim 1, wherein the power unit includes a removable access cap having a variable speed and direction controller for the device.

3. The device according to claim 1, wherein the power source is a battery.

4. The device of claim 1, wherein the stimulator includes:

a second shaft extending distal to the eccentric coupling, wherein the second shaft is mounted in the coupling at variable radii in relation to the output shaft and extending distal into the stimulator; and an element affixed to a distal end of the second shaft with an outside surface fitted within the stimulator to prevent the stimulator and flexible covering from continuous winding with the second shaft and to free the stimulator to allow torsional oscillation, wherein the eccentric coupling is weighted to enhance radial vibration from the stimulator.

5. The device of claim 2, wherein the flexible covering includes a material having an elastic property that aids in control of oscillatory amplitudes.

6. The device of claim 4, wherein the eccentric coupling possesses an arm for changing a radius controlled by a direction of an motor output.

7. The device of claim 4, wherein the element is a sealed-ball bearing.

8. The device of claim 4, wherein the element is a clutch assembly to control the torsional oscillation.

9. The device of claim 4, wherein the element is a separate DC motor with independent control of the torsional oscillation.

10. The device of claim 4, wherein the stimulator further includes a stimulator cap for altering a profile and imbalance of the stimulator and altering an amplitude of the torsional oscillation.

11. The device of claim 1, wherein the power unit is controlled wirelessly.

12. The device of claim 1, wherein the output shaft is flexible to protect the motor from radial loads.

13. The device of claim 1, wherein the power unit is programmable to provide modes with varying speed, direction, on/off cycling, and enhanced torsional control and orbit control.

14. A tri-motion tactile stimulation device for producing simultaneous radial vibration, orbital motion and either rotational or torsional oscillation to a person, comprising:

a first portion housing a power supply, a rotary motor with an output shaft and a controller;

a second portion having an active segment with an eccentric coupler generating the radial vibration and an axle securely connected to the eccentric coupler carrying out an orbit of the second portion; and a removable flexible covering surrounding the first and second portions, wherein the flexible covering eliminates three hundred sixty degree independent rotation of the active segment by bridging the first portion to the second portion to allow orbiting and oscillating torsion through stretch or elasticity.

15. The device of claim 14, wherein the removable flexible covering is waterproof.

16. The device of claim 14, wherein the removable flexible covering changes color with temperature changes.

17. The device of claim 14, wherein the removable flexible covering is made of silicon.

18. A portable, variable-speed stimulation device, comprising:

a power unit having an access cap connected thereto;

a stimulating unit having a stimulator cap;

a weighted coupler contained within the stimulating unit, said weighted coupler modulating an amplitude of a radial vibration and a radius of an orbit of the stimulating unit and the stimulator cap; and a DC ball bearing motor having an output shaft projecting distal into the stimulating unit;

whereby a gap between the stimulator cap and the power unit enables orbiting and torsion of the stimulating unit such that the device simultaneously produces orbital motion, torsional oscillation and radial vibration in the stimulating unit.

* * * * *